US006227956B1

(12) United States Patent
Halley

(10) Patent No.: US 6,227,956 B1
(45) Date of Patent: May 8, 2001

(54) PAD QUICK RELEASE DEVICE FOR CHEMICAL MECHANICAL POLISHING

(75) Inventor: David G. Halley, Los Osos, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 09/432,882

(22) Filed: Nov. 2, 1999

Related U.S. Application Data

(60) Provisional application No. 60/162,282, filed on Oct. 28, 1999.

(51) Int. Cl.[7] ..... B24B 29/00

(52) U.S. Cl. ..... 451/288; 451/56; 451/72; 451/304; 451/443; 451/444

(58) Field of Search ..... 451/56, 72, 304, 451/443, 444

(56) References Cited

U.S. PATENT DOCUMENTS 4,319,432 * 3/1982 Day ..... 451/288
5,980,367 * 11/1999 Metcalf ..... 451/285
6,022,807 2/2000 Lindsey, Jr. et al. .
6,042,457 * 3/2000 Wilson et al. ..... 451/56

* cited by examiner

*Primary Examiner*—Joseph J. Hail, III
*Assistant Examiner*—Shantese McDonald
(74) *Attorney, Agent, or Firm*—Townsend and Townsend and Crew LLP

(57) ABSTRACT

A chemical-mechanical polishing apparatus (100, 200) comprising a polishing pad assembly. The polishing pad assembly (300) comprises a removable cap (318) to be rotatably coupled to a drive device of a chemical mechanical polishing apparatus and a polishing pad comprising a fixed abrasive disposed on the removable cap. The removable cap (318) and the polishing pad being a detached unit to be attached to or removed from the drive device.

21 Claims, 3 Drawing Sheets

PAD QUICK RELEASE DEVICE FOR CHEMICAL MECHANICAL POLISHING

CROSS-REFERENCES TO RELATED APPLICATIONS

This application is related to U.S. Provisional Application No. 60/162,282, filed Oct. 28, 1999, entitled "Pad Quick Release Device For Chemical Mechanical Polishing," owned by the Assignee of the present application, the entire contents of which is incorporated herein by reference.

BACKGROUND OF THE INVENTION

The present invention relates to the manufacture of objects. More particularly, the invention provides a technique including a device for planarizing a film of material of an article such as a semiconductor wafer. However, it will be recognized that the invention has a wider range of applicability; it can also be applied to flat panel displays, hard disks, raw wafers, and other objects that require a high degree of planarity.

The fabrication of integrated circuit devices often begins by producing semiconductor wafers cut from an ingot of single crystal silicon which is formed by pulling a seed from a silicon melt rotating in a crucible. The ingot is then sliced into individual wafers using a diamond cutting blade. Following the cutting operation, at least one surface (process surface) of the wafer is polished to a relatively flat, scratch-free surface. The polished surface area of the wafer is first subdivided into a plurality of die locations at which integrated circuits (IC) are subsequently formed. A series of wafer masking and processing steps are used to fabricate each IC. Thereafter, the individual dice are cut or scribed from the wafer and individually packaged and tested to complete the device manufacture process.

During IC manufacturing, the various masking and processing steps typically result in the formation of topographical irregularities on the wafer surface. For example, topographical surface irregularities are created after metallization, which includes a sequence of blanketing the wafer surface with a conductive metal layer and then etching away unwanted portions of the blanket metal layer to form a metallization interconnect pattern on each IC. This problem is exacerbated by the use of multilevel interconnects.

A common surface irregularity in a semiconductor wafer is known as a step. A step is the resulting height differential between the metal interconnect and the wafer surface where the metal has been removed. A typical VLSI chip on which a first metallization layer has been defined may contain several million steps, and the whole wafer may contain several hundred ICs.

Consequently, maintaining wafer surface planarity during fabrication is important. Photolithographic processes are typically pushed close to the limit of resolution in order to create maximum circuit density. Typical device geometries call for line widths on the order of 0.5 $\mu$M. Since these geometries are photolithographically produced, it is important that the wafer surface be highly planar in order to accurately focus the illumination radiation at a single plane of focus to achieve precise imaging over the entire surface of the wafer. A wafer surface that is not sufficiently planar, will result in structures that are poorly defined, with the circuits either being nonfunctional or, at best, exhibiting less than optimum performance. To alleviate these problems, the wafer is "planarized" at various points in the process to minimize non-planar topography and its adverse effects. As additional levels are added to multilevel-interconnection schemes and circuit features are scaled to submicron dimensions, the required degree of planarization increases. As circuit dimensions are reduced, interconnect levels must be globally planarized to produce a reliable, high density device. Planarization can be implemented in either the conductor or the dielectric layers.

In order to achieve the degree of planarity required to produce high density integrated circuits, chemical-mechanical planarization processes ("CMP") are being employed with increasing frequency. A conventional rotational CMP apparatus includes a wafer carrier for holding a semiconductor wafer. A soft, resilient pad is typically placed between the wafer carrier and the wafer, and the wafer is generally held against the resilient pad by a partial vacuum. The wafer carrier is designed to be continuously rotated by a drive motor. In addition, the wafer carrier typically is also designed for transverse movement. The rotational and transverse movement is intended to reduce variability in material removal rates over the surface of the wafer. The apparatus further includes a rotating platen on which is mounted a polishing pad. The platen is relatively large in comparison to the wafer, so that during the CMP process, the wafer may be moved across the surface of the polishing pad by the wafer carrier. A polishing slurry containing chemically-reactive solution, in which are suspended abrasive particles, is deposited through a supply tube onto the surface of the polishing pad.

CMP is advantageous because it can be performed in one step, in contrast to prior planarization techniques which tend to be more complex, involving multiple steps. For example, planarization of CVD interlevel dielectric films can be achieved by a sacrificial layer etchback technique. This involves coating the CVD dielectric with a film which is then rapidly etched back (sacrificed) to expose the topmost portions of the underlying dielectric. The etch chemistry is then changed to provide removal of the sacrificial layer and dielectric at the same rate. This continues until all of the sacrificial layer has been etched away, resulting in a planarized dielectric layer.

Many other limitations, however, exist with CMP. Specifically, CMP often involves a large polishing pad, which uses a large quantity of slurry material. The large polishing pad is often difficult to control and requires expensive and difficult to control slurries. Additionally, the large polishing pad is often difficult to remove and replace. The large pad is also expensive and consumes a large foot print in the fabrication facility. These and other limitations still exist with CMP and the like.

What is needed is an improvement of the CMP technique to improve the degree of global uniformity that can be achieved using CMP.

SUMMARY OF THE INVENTION

According to the present invention, a technique including a device for chemical mechanical polishing of objects is provided. In an exemplary embodiment, the invention provides a polishing pad, which is mounted on a cap. The cap is rotatably coupled to a drive head of a polishing apparatus. The apparatus includes a smaller polishing pad, relative to the size of the object being polished.

In a specific embodiment, the present invention provides a chemical-mechanical polishing apparatus. The apparatus has a rigid polishing head support coupled to a stage assembly for holding an object for chemical mechanical polishing. The apparatus also has a drive device (e.g., drive shaft) coupled to the polishing head support, where the drive device comprises a mechanical drive to provide rotational movement of the drive device about a center axis. The drive device extends from a first end to a second end. A removable cap is rotatably coupled to the drive device at the second end, where the removable cap is aligned with the center axis of the drive device. Additionally, the apparatus has a polishing pad disposed on the removable cap. In other embodiments, the cap can be attached to the drive device using other suitable means.

In an alternative specific embodiment, the present invention provides a chemical-mechanical polishing apparatus. The apparatus has a rigid polishing head support coupled to a stage assembly for holding an object for chemical mechanical polishing. The apparatus also has a drive device coupled to the polishing head support, where the drive device comprises a mechanical drive to provide rotational movement of the drive device about a center axis. The drive device extends from a first end to a second end and has an inner orifice therein that also extends from the first end to the second end. The apparatus further has a removable cap rotatably coupled to the drive device at the second end. The removable cap is aligned with the center axis of the drive device, and is aligned to the inner orifice. In a specific embodiment, a polishing pad comprising a fixed abrasive disposed on the removable cap also is included.

In a further embodiment, the present invention provides yet another chemical-mechanical polishing apparatus comprising a polishing pad assembly. The polishing pad assembly comprises a removable cap to be rotatably coupled to a drive device of a chemical mechanical polishing apparatus and a polishing pad comprising a fixed abrasive disposed on the removable cap. The removable cap and the polishing pad being a detached unit to be attached to or removed from the drive device.

Numerous benefits are achieved by way of the present invention over conventional techniques. In some embodiments, the present invention provides an improved way to attach and remove the polishing pad. Additionally, the invention provides an improved technique for the manufacture of objects. For example, the invention allows multiple processes in a single chamber. This reduces the risks caused by moving a wafer between process stations as is done in conventional system. The invention brings the process to the wafer, instead of bringing the wafer to the process. Depending upon the embodiment, one or more of these benefits may exist. These and others will be described in more detail throughout the present specification and more particularly below.

The present invention achieves these benefits in the context of known process technology and known techniques in the mechanical arts. However, a further understanding of the nature and advantages of the present invention may be realized by reference to the latter portions of the specification and attached drawings.

DESCRIPTION OF THE SPECIFIC EMBODIMENTS

According to the present invention, a technique including a device for chemical mechanical polishing of objects is provided. In an exemplary embodiment, the invention provides a polishing pad, which is mounted on a cap. The cap is rotatably coupled to a drive head of a polishing apparatus. The apparatus includes a smaller polishing pad, relative to the size of the object being polished.

Figure 1:
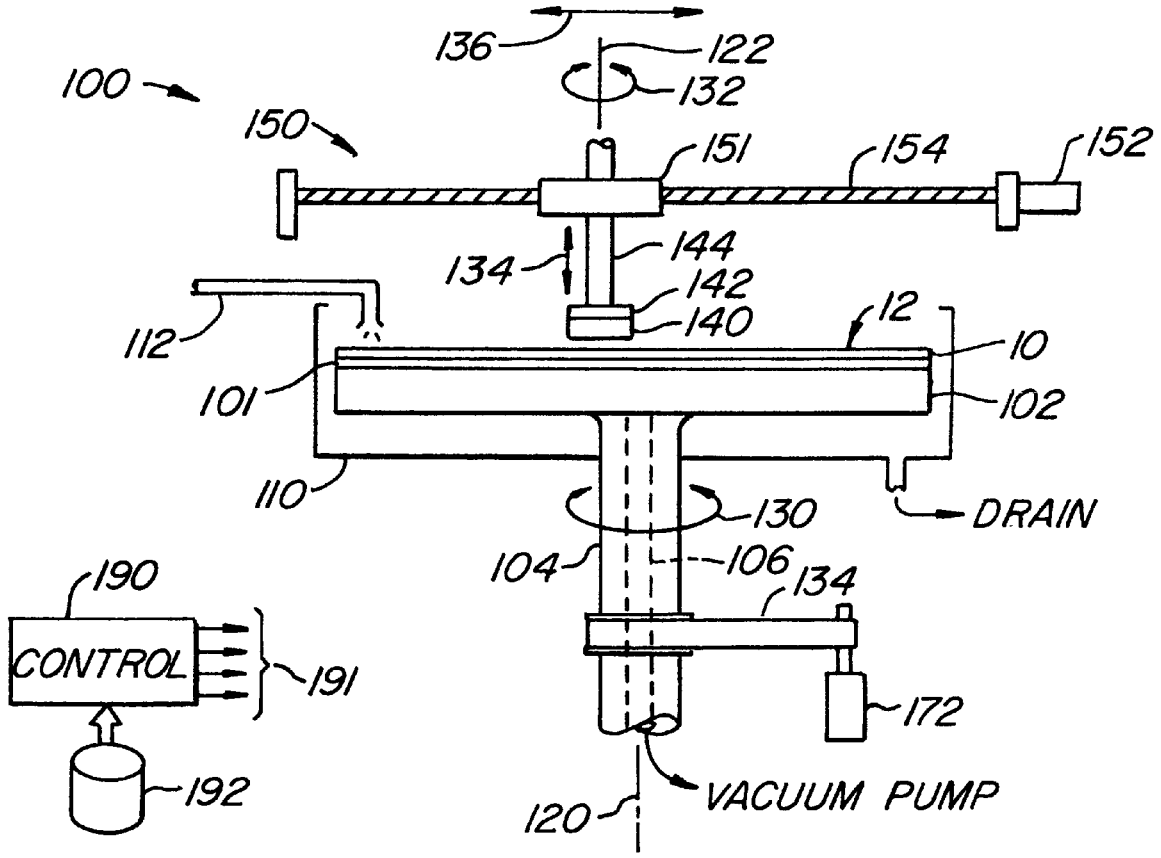
FIG. 1 is a simplified polishing apparatus according to an embodiment of the present invention.

Referring to FIG. 1, a chemical-mechanical polishing apparatus 100 according to the invention includes a chuck 102 for holding a wafer 10 in position during a polishing operation. The apparatus shown is merely an example and has been simplified to facilitate a discussion of the salient aspects of the invention. As such, the figure should not unduly limit the scope of the claims herein. One of ordinary skill in the art would recognize many other variations, alternatives, and modifications.

The chuck includes a drive spindle 104 which is coupled to a motor 172 via a drive belt 174 to rotate the wafer about its axis 120. Preferably, the motor is a variable-speed device so that the rotational speed of the wafer can be varied. In addition, the direction of rotation of the motor can be reversed so that the wafer can be spun in either a clockwise direction or a counterclockwise direction. Typically, servo motors are used since their speed can be accurately controlled, as well as their direction of rotation. Alternative drive means include, but are not limited to, direct drive and gear-driven arrangements.

A channel 106 formed through spindle 104 is coupled to a vacuum pump through a vacuum rotary union (not shown). Chuck 102 may be a porous material, open to ambient at its upper surface so that air drawn in from the surface through channel 106 creates a low pressure region near the surface. A wafer placed on the chuck surface is consequently held in place by the resulting vacuum created between the wafer and the chuck. Alternatively, chuck 102 may be a solid material having numerous channels formed through the upper surface, each having a path to channel 106, again with the result that a wafer placed atop the chuck will be held in position by a vacuum. Such vacuum-type chucks are known and any of a variety of designs can be used with the invention. In fact, mechanical clamp chucks can be used. However, these types are less desirable because the delicate surfaces of the wafer to be polished can be easily damaged by the clamping mechanism. In general, any equivalent method for securing the wafer in a stationary position and allowing the wafer to be rotated would be equally effective for practicing the invention.

A wafer backing film 101 is disposed atop the surface of chuck 102. The backing film is a polyurethane material. The material provides compliant support structure which is typically required when polishing a wafer. When a compliant backing is not used, high spots on a wafer prevent the pad from contacting the thinner areas (low spots) of the wafer. The compliant backing material permits the wafer to deflect enough to flatten its face against the polish pad. There can be a deflection of several thousands of an inch deflection under standard polishing forces. Polyurethane is not necessary, however, as any appropriate compliant support material will work equally well in this invention.

FIG. 1 also shows a polishing pad assembly comprising a polishing pad 140, a chuck 142 for securing the pad in position, and a pad spindle 144 coupled to the chuck for rotation of the pad about its axis 122. In accordance with the invention, the pad radius is less than the radius of wafer 10, typically around 20% of the wafer radius. A drive motor (not shown) is coupled to pad spindle 144 to provide rotation of the pad. Preferably, the drive motor is a variable-speed device so that the rotational speed of pad 140 during a particular polishing operation can be controlled. The drive motor preferably is reversible.

Figure 2:
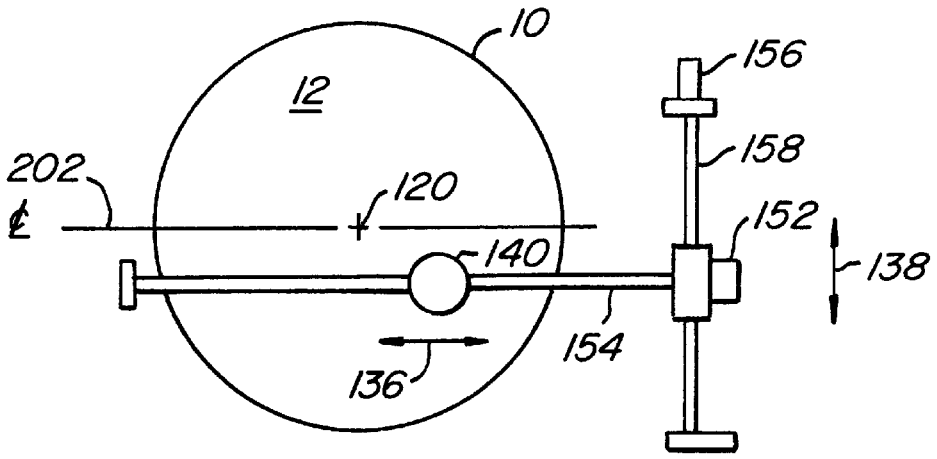
FIG. 2 is an alternative detailed diagram of a polishing apparatus according to an embodiment of the present invention.

Referring to FIGS. 1 and 2, a traverse mechanism 150 provides translational displacement of the polishing pad assembly across the wafer surface. In one embodiment of the invention, the traverse mechanism is an x-y translation stage that includes a platform 151 for carrying the pad assembly. The traverse mechanism 150 further includes drive screws 154 and 158, each respectively driven by motors 152 and 156 to move platform 151. Motors 152 and 156 respectively translate platform 151 in the x-direction, indicated by reference numeral 136, and in the y-direction, indicated by reference numeral 138. Motors 152 and 156 preferably are variable-speed devices so that the translation speed can be controlled during polishing. Stepper motors are typically used to provide high accuracy translation and repeatability.

It is noted that the function of traverse mechanism 150 can be provided by other known translation mechanisms as alternatives to the aforementioned x-y translation stage. Alternative mechanisms include pulley-driven devices and pneumatically operated mechanisms. The present invention would be equally effective regardless of the particular mechanical implementation selected for the translation mechanism.

Continuing with FIG. 1, the pad 140 is oriented relative to wafer 10 such that process surface 12 of the wafer is substantially horizontal and faces upwardly. The polishing surface of pad 140 is lowered onto process surface 12 of the wafer. This arrangement of wafer surface to pad surface is preferred. If a power failure occurs, the various components in the CMP apparatus will likely cease to operate. In particular, the vacuum system is likely to stop functioning. Consequently, wafer 10 will no longer be held securely in place by vacuum chuck 102. However, since the wafer is already in a neutral position, the wafer will not fall and become damaged when the chuck loses vacuum but will simply rest upon the chuck.

The pad assembly is arranged on the translation stage of traverse mechanism 150 to allow for motion in the vertical direction which is indicated in FIG. 1 by reference numeral 134. This allows for lowering the pad onto the wafer surface for the polishing operation. Preferably, pad pressure is provided by an actuator (e.g., a piston-driven mechanism, voice coil, servo motor, lead screw assembly, and the like) having variable-force control in order to control the downward pressure of the pad upon the wafer surface. The actuator is typically equipped with a force transducer to provide a downforce measurement which can be readily converted to a pad pressure reading. Numerous pressure-sensing actuator designs, known in the relevant engineering arts, can be used.

A slurry delivery mechanism 112 is provided to dispense a polishing slurry onto process surface 12 of wafer 10 during a polishing operation. Although FIG. 1 shows a single dispenser 112, additional dispensers may be provided depending on the polishing requirements of the wafer. Polishing slurries are known in the art. For example, typical slurries include a mixture of colloidal silica or dispersed alumina in an alkaline solution such as KOH, $NH_4OH$ or $CeO_2$. Alternatively, slurry-less pad systems can be used.

A splash shield 110 is provided to catch the polishing fluids and to protect the surrounding equipment from the caustic properties of any slurries that might be used during polishing. The shield material can be polypropylene or stainless steel, or some other stable compound that is resistant to the corrosive nature of polishing fluids.

A controller 190 in communication with a data store 192 issues various control signals 191 to the foregoing-described components of polishing apparatus 100. The controller provides the sequencing control and manipulation signals to the mechanics to effectuate a polishing operation. The data store 192 preferably is externally accessible. This permits user-supplied data to be loaded into the data store to provide polishing apparatus 100 with the parameters for performing a polishing operation. This aspect of the preferred embodiment will be further discussed below.

Any of a variety of controller configurations are contemplated for the present invention. The particular configuration will depend on considerations such as throughput requirements, available footprint for the apparatus, system features other than those specific to the invention, implementation costs, and the like. In one embodiment, controller 190 is a personal computer loaded with control software. The personal computer includes various interface circuits to each component of polishing apparatus 100. The control software communicates with these components via the interface circuits to control apparatus 100 during a polishing operation. In this embodiment, data store 192 can be an internal hard drive containing desired polishing parameters. User-supplied parameters can be keyed in manually via a keyboard (not shown). Alternatively, data store 192 is a floppy drive in which case the parameters can be determined elsewhere, stored on a floppy disk, and carried over to the personal computer. In yet another alternative, data store 192 is a remote disk server accessed over a local area network. In still yet another alternative, the data store is a remote computer accessed over the Internet; for example, by way of the world wide web, via an FTP (file transfer protocol) site, and so on. Additionally, the invention will work in systems which employ older technologies such as PLC-based (programmable logic control) systems.

In another embodiment, controller 190 includes one or more microcontrollers which cooperate to perform a polishing sequence in accordance with the invention. Data store 192 serves as a source of externally-provided data to the microcontrollers so they can perform the polish in accordance with user-supplied polishing parameters. It should be apparent that numerous configurations for providing user-supplied polishing parameters are possible. Similarly, it should be clear that numerous approaches for controlling the constituent components of the CMP are possible.

Figure 3:
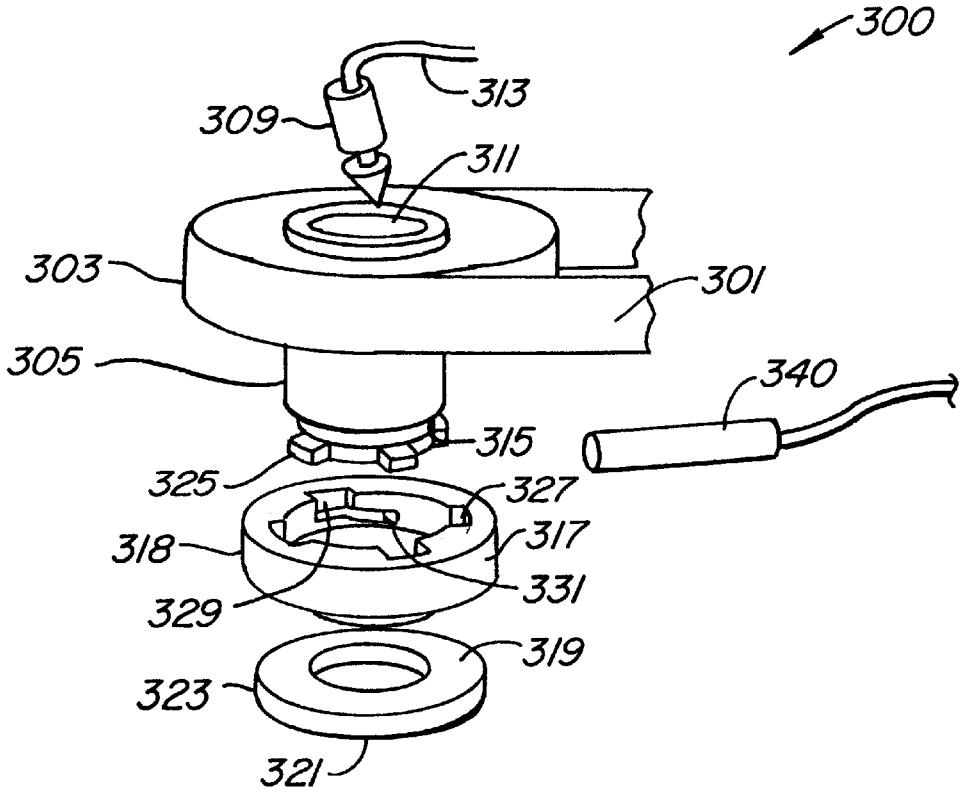
FIG. 3 is a simplified diagram of a drive and cap assembly according to an embodiment of the present invention.

FIG. 3 is a simplified diagram of a drive and cap assembly on a polishing head 300 according to an embodiment of the present invention. The assembly is merely an example and has been simplified to facilitate a discussion of the salient aspects of the invention. As such, the figure should not unduly limit the scope of the claims herein. One of ordinary skill in the art would recognize many other variations, alternatives, and modifications. As shown, the polishing head 300 includes a variety of features such as a support structure 301, which couples to a support. Additionally, the polishing head includes a drive device 303, which couples to a drive shaft 305. The drive shaft has a first end, which is attached to the drive device, and a second end, which includes a coupling 315. The coupling mates to a removable cap 317, which includes an outer region 318. The removable cap rotatably attaches to the coupling in a secure manner.

Although the present cap is rotatable, it is understood that other known mechanical coupling techniques of attaching the cap to the coupling can be subsitituted. The rotatable cap also has a polishing pad 323, which can be fixed to the cap before it is secured to the coupling. The polishing pad may have an opening 321, but can also be one continuous member. The top surface 319 of the pad contacts the cap to secure it in place.

Now, to secure the removable cap onto the coupling, the cap is brought into contact and is aligned to the coupling. Here, each of the threads 325 is aligned with a respective thread opening 327, inserted along a first direction toward the support structure, until each thread bottoms against a stop 329 in the opening. Next, the cap is rotated in a counter clockwise manner, where the groove 331 guides each thread such that the cap biases against the coupling to secure it in place. Once the cap is secured, the drive 305 rotates the pad in a counter clockwise circular manner during a process operation. By way of the counter clockwise manner, the cap does not loosen up and continues to be biased against the coupling. In other embodiments, the rotatable cap and coupling are mated to each other in a clockwise manner, where the drive rotates the pad in a clockwise manner. In an embodiment, the removable cap couples to the drive in a sealed manner.

To remove the cap from the coupling, the drive is secured in place manually or by a brake, where the rotatable coupling cannot be rotated through the drive. The cap is grasped and turned in a clockwise manner, which guides each thread away from the bias to release the cap from the coupling. Once each thread is aligned with its opening, the cap is dropped to free it from the coupling. Again, in other embodiments, the rotatable cap and coupling have been mated to each other in a clockwise manner, where the drive rotates the pad in a clockwise manner. In a preferred embodiment, the present cap is removed from the coupling by way of the technique illustrated by FIG. 4 below. This technique provides an automatic or "hands free" approach to removing the cap from the coupling.

The present cap, which is rotatably attached, can be replaced by other types of coupling devices. For example, the coupling device may not require a rotational movement. Rather, any mechanically actuated attachment and detachment is contemplated.

The polishing head also includes a sensing device 309, which is coupled to a processing unit, such as the one noted but can be others. The sensing device can look through an inner opening 311 of the drive shaft 305 to the polishing pad. In some embodiments, the polishing pad is annular in structure with an opening 321 in the center. The opening allows the sensor to sense a fluid level or slurry level at the workpiece surface, which is exposed through the center opening in the pad. A typical sensor arrangement is to employ an optical sensor.

In addition, a position sensor, schematically illustrated as sensor 340 in FIG. 3, can be provided during replacement of an old polishing pad with a new polishing pad. The sensor would provide positional information as to the location of the pad being removed to ensure that it has adequately cleared the pad assembly. The sensor would also be used to confirm that a new polishing pad is properly secured to the pad assembly.

Figure 3A:
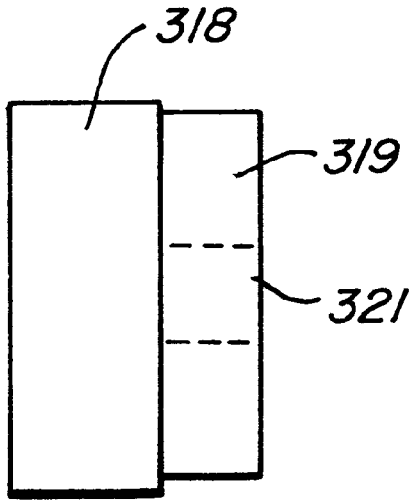
FIG. 3A is a simplified diagram of a combined cap and pad assembly according to an embodiment of the present invention.

FIG. 3A is a simplified diagram of a combined cap and pad assembly according to an embodiment of the present invention. This diagram is merely an illustration, which should not limit the scope of the claims herein. One of ordinary skill in the art would recognize many other variations, modifications, and alternatives. In a specific embodiment, the removable cap and polishing pad are in an assembly. The assembly is provided to the manufacturer of integrated circuits, for example, for use with the present polishing apparatus. The assembly can be pre-packaged in a clean room pack. The assembly can include the cap 318 and the pad 319, which may include an inner orifice or opening 321. Depending upon the embodiment, the pad can be one of a variety forms according to the present invention.

The cap can be made of a suitable material to withstand both chemical and physical conditions. Here, the cap can be made of a material called PET, DELRIN, as well as PEEK, or even stainless steel on titanium. The cap is also preferably transparent, which allows the sensing device to pick up optical signals from the workpiece surface. The cap is also sufficiently rigid to withstand torque from the drive shaft. The cap can also withstand exposure to acids, bases, water, and other types of chemicals, depending upon the embodiment. The cap also has a resilient outer surface to prevent it from damage from slurries, abrasive, and other physical materials. Further details of removing the cap are provided below.

Figure 4:
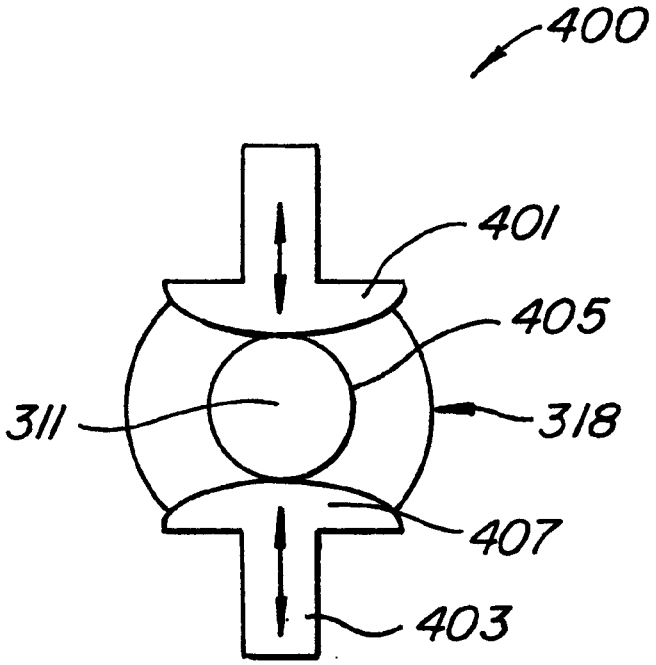
FIG. 4 is a simplified diagram of a polishing pad according to an embodiment of the present invention.

FIG. 4 is a simplified diagram of a polishing pad device 400 according to an embodiment of the present invention. The device is merely an example and has been simplified to facilitate a discussion of the salient aspects of the invention. As such, the figure should not unduly limit the scope of the claims herein. One of ordinary skill in the art would recognize many other variations, alternatives, and modifications. In a preferred embodiment to remove the cap, the cap 318 is placed between two handling arms 401, 403. Each of the arms places a lateral force against the cap to hold it in place. The motor drives the drive shaft in a clockwise (or counter clockwise) manner to release the threads of the cap from the coupling. Once the threads have been released the drive shaft is lifted to free the cap from the coupling.

Next, the removed cap is placed into a disposal. Here, the handling arms can move the cap from a removal location to a disposal location. For example, the disposal location may comprise a simple chute to a waste receptacle. Alternatively, any of a number of chip removal systems commonly used the CNC industry such as a conveyer auger, and so on.

While the above is a full description of the specific embodiments, various modifications, alternative constructions and equivalents known to those of ordinary skill in the relevant arts may be used. For example, while the description above is in terms of a semiconductor wafer, it would be possible to implement the present invention with almost any type of article having a surface or the like. Therefore, the above description and illustrations should not be taken as limiting the scope of the present invention which is defined by the appended claims.

What is claimed is:

1. A chemical-mechanical polishing apparatus comprising:

a polishing head support coupled to a stage assembly for holding an object for chemical mechanical polishing;

a drive device coupled to the polishing head support, the drive device comprising a mechanical drive to provide rotational movement of the drive device about a center axis, the drive device extending from a first end to a second end;

a removable cap mechanically coupled to the drive device at the second end, the removable cap being aligned with the center axis of the drive device; and a polishing pad disposed on the removable cap, the polishing pad to be placed in contact with the object for chemical-mechanically polishing the object.

2. The apparatus of claim 1 wherein the removable cap rotatably couples in a first direction to be substantially fixed to the drive device.

3. The apparatus of claim 1 wherein the first direction is a drive direction of the drive device to rotate the polishing pad.

4. The apparatus of claim 1 wherein the removable cap is optically transparent.

5. The apparatus of claim 1 wherein the polishing pad is mounted on the removable cap.

6. The apparatus of claim 1 wherein the removable cap couples to the drive device through a plurality of threads, which mate with each other between the removable cap and the drive device.

7. The apparatus of claim 1 wherein the removable cap couples to the drive in a sealed manner.

8. A chemical-mechanical polishing apparatus comprising:

a polishing head support coupled to a stage assembly for holding an object for chemical mechanical polishing;

a drive device coupled to the polishing head support, the drive device comprising a mechanical drive to provide rotational movement of the drive device about a center axis, the drive device extending from a first end to a second end;

a removable cap mechanically coupled to the drive device at the second end, the removable cap being aligned with the center axis of the drive device; and a polishing pad disposed on the removable cap, wherein the polishing head support comprises an inner orifice that extends from a first end to a second end, the second end being coupled to the removable cap.

9. The apparatus of claim 8 further comprising a sensing device coupled to the first end, the sensing device being adapted to capture a signal derived through the removable cap and through the inner orifice.

10. The apparatus of claim 8 wherein the polishing pad comprises an annular shape, the annular shape comprising an opening, the opening being aligned with the inner orifice.

11. A chemical-mechanical polishing apparatus comprising:

a polishing head support coupled to a stage assembly for holding an object for chemical mechanical polishing;

a drive device coupled to the polishing head support, the drive device comprising a mechanical drive to provide rotational movement of the drive device about a center axis, the drive device extending from a first end to a second end and having an inner orifice therein that also extends from the first end to the second end;

a removable cap rotatably coupled to the drive device at the second end, the removable cap being aligned with the center axis of the drive device, the removable cap being aligned to the inner orifice that extends from the first end to the second end; and a polishing pad comprising a fixed abrasive disposed on the removable cap.

12. The apparatus of claim 11 wherein the removable cap rotatably couples in a first direction to be fixed to the drive device.

13. The apparatus of claim 11 wherein the first direction is a drive direction of the drive device to rotate the polishing pad.

14. The apparatus of claim 11 wherein the removable cap is optically transparent.

15. The apparatus of claim 11 further comprising a sensing device coupled to the first end, the sensing device being adapted to capture a signal derived through the removable cap and through the inner orifice.

16. The apparatus of claim 11 wherein the polishing pad is mounted on the removable cap.

17. The apparatus of claim 11 wherein the polishing pad comprises an annular shape, the annular shape comprising an opening, the opening being aligned with the inner orifice.

18. The apparatus of claim 11 wherein the removable cap couples to the drive device through a plurality of threads, which mate with each other between the removable cap and the drive device.

19. The apparatus of claim 11 wherein the removable cap couples to the drive in a sealed manner.

20. A chemical-mechanical polishing apparatus comprising a polishing pad assembly for polishing an object, the polishing pad assembly comprising a removable cap to be rotatably coupled to a drive device of a chemical-mechanical polishing apparatus and a polishing pad comprising a fixed abrasive, the polishing pad being disposed on the removable cap, the polishing pad to be placed in contact with the object for chemical-mechanically polishing the object; the removable cap and the polishing pad being a detached unit to be attached to or removed from the drive device.

21. A chemical-mechanical polishing apparatus comprising a polishing pad assembly for polishing an object, the polishing pad assembly comprising a removable cap to be rotatably coupled to a drive device of a chemical mechanical polishing apparatus and a polishing pad comprising a loose abrasive, the pad being disposed on the removable cap, the polishing pad to be placed in contact with the object for chemical-mechanically polishing the object; whereupon the removable cap and the polishing pad comprise a unit that can be attached to or removed from the drive device.

* * * * *